United States Patent [19]

Hayashi

[11] 4,436,061

[45] Mar. 13, 1984

[54] AUTOMOTIVE INTERNAL COMBUSTION ENGINE

[75] Inventor: Yoshimasa Hayashi, Kamakura, Japan

[73] Assignee: Nissan Motor Co., Ltd., Yokohama, Japan

[21] Appl. No.: 319,886

[22] Filed: Nov. 10, 1981

[30] Foreign Application Priority Data

Nov. 14, 1980 [JP] Japan ..... 55-163329[U]

[51] Int. Cl.[3] ..... F01P 3/02

[52] U.S. Cl. ..... 123/41.74; 123/41.82 R

[58] Field of Search ..... 123/41.74, 41.82 R, 123/41.82 A, 41.75, 41.72

[56] References Cited

U.S. PATENT DOCUMENTS

| | | | |
|---|---|---|---|
| 1,033,783 | 7/1912 | Collinet | 123/41.82 R |
| 2,972,341 | 2/1961 | Forst | 123/41.72 |
| 3,173,407 | 3/1965 | Sampietro et al. | 123/41.74 |
| 3,646,919 | 3/1972 | Reisacher | 123/41.74 |
| 4,175,503 | 11/1979 | Ernest | 123/41.72 |

FOREIGN PATENT DOCUMENTS

| | | |
|---|---|---|
| 175747 | 8/1953 | Fed. Rep. of Germany . |
| 2825298 | 11/1979 | Fed. Rep. of Germany . |
| 2054643 | 4/1971 | France . |
| 2306340 | 1/1976 | France . |
| 54-142412 | 6/1979 | Japan . |
| 1496451 | 12/1977 | United Kingdom . |
| 2021691 | 12/1979 | United Kingdom . |

*Primary Examiner*—William A. Cuchlinski, Jr.

*Attorney, Agent, or Firm*—Schwartz, Jeffery, Schwaab, Mack, Blumenthal & Koch

[57] ABSTRACT

An automotive internal combustion engine comprises a cylinder head having at its bottom surface two oppositely disposed projections which extend along the length of the cylinder head, and a cylinder block without an upper block deck, having two water jacket walls which are oppositely disposed to interpose therebetween a plurality of cylinder sections. The upper end part of the cylinder block fits inbetween the two projections of the cylinder head, thereby effectively preventing the cylinder block upper end part from vibrating.

10 Claims, 5 Drawing Figures

AUTOMOTIVE INTERNAL COMBUSTION ENGINE

BACKGROUND OF THE INVENTION

1. Field of the Invention

This invention relates to an automotive internal combustion engine having a cylinder block which is not provided with a so-called upper block deck, and more particularly to an engine construction made of a light alloy and produced by die-casting and having a firm connection between a cylinder head and the cylinder block.

2. Description of the Prior Art

In connection with automotive internal combustion engines, it is well known to die cast a cylinder block using light alloy as the material thereof. Such a die-casted cylinder block is in general not provided with a so-called upper block deck, so that the upper part of a water jacket wall of the cylinder block is separate from the upper part of a cylinder row structure including a plurality of cylinder sections each being formed therein with an engine cylinder bore. A cylinder block produced by a conventional casting using molding sand is provided with an upper block deck which serves to integrally connect the water jacket wall upper part and the cylinder row structure upper part. The reason why the upper block deck is not provided in the die-casted cylinder block is that a metallic die for the water jacket is drawn out upwardly during die-casting thereof. As a result, the upper part of the water jacket wall is not restrained at all by each cylinder section. This leads to shortage in flexural and torsional rigidities of the cylinder block, and, particularly the upper part of the cylinder block is susceptible to noticeable vibrations.

BRIEF SUMMARY OF THE INVENTION

In accordance with the present invention, an automotive internal combustion engine comprises a cylinder head having at its bottom surface two oppositely disposed projections which extend along the length of the cylinder head. The cylinder head is secured to a cylinder block which is not provided with an upper block deck. The upper end part of the cylinder block fits in between the projections of the cylinder head. With this arrangement, the upper end part of the cylinder block can be prevented from vibrating in the lateral direction of the cylinder block, thereby effectively achieving noise reduction in the cylinder block.

BRIEF DESCRIPTION OF THE DRAWINGS

The features and advantages of the internal combustion engine according to the present invention will be more clearly appreciated from the following description taken in conjunction with the accompanying drawings in which like reference numerals designate like parts and elements, and in which.

DETAILED DESCRIPTION OF THE INVENTION

Figure 1:
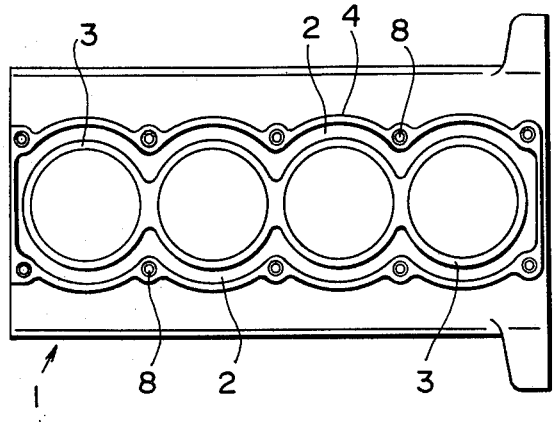
FIG.1 PRIOR ART
FIG. 1 is a top plan view of a cylinder block of a conventional internal combustion engine.
Figure 2:
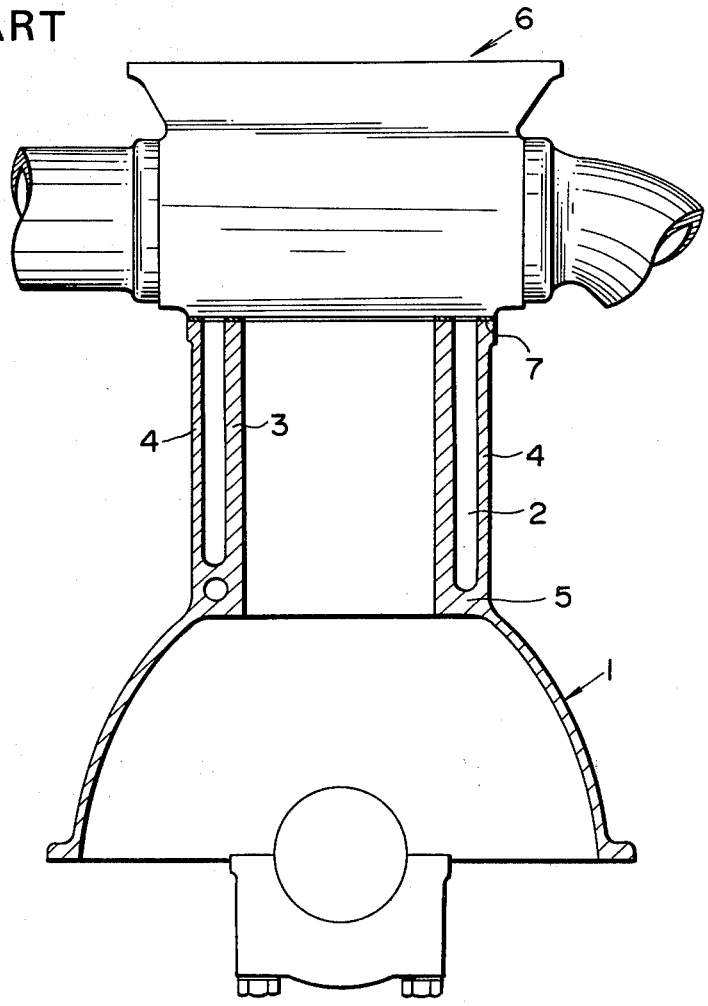
FIG.2 PRIOR ART
FIG. 2 is a vertical cross-sectional view of the cylinder head of FIG. 1, equipped with a cylinder block and main bearing caps.

To facilitate understanding the present invention, a brief reference is made to a conventional internal combustion engine configuration, depicted in FIGS. 1 and 2. The engine in this instance is composed of a cylinder block 1 made of light alloy. Such a light alloy-made cylinder block 1 is in general produced by die-casting, and therefore, it is so constructed and arranged as not to be provided with an upper block deck thereof. The reason for this is that, during die-casting, a metallic die for the water jacket is drawn out upwardly, and this die corresponds to a water jacket core in case of casting using molding sand. As a result a water jacket 2 is formed along the whole periphery of a plurality of cylinder (liner) sections 3 and between a water jacket wall 4 and the cylinder sections 3. As clearly shown, since the cylinder block 1 is not provided with the upper block deck thereof, the upper part of the water jacket wall 4 is separate from the upper part of each cylinder section 3, forming therebetween the water jacket 2. The water jacket wall 4 is integrally connected only at its bottom part 5 to the cylinder sections 3 to be firmly restrained thereby, and not restrained at its upper part. Additionally, a cylinder head 6 is merely mounted on the top surface of the cylinder block 1 through a head gasket 7 and fastened by using bolts each of which is securely inserted into a hole 8 formed at the water jacket wall 4.

However, with such an engine configuration, because of the fact that the cylinder block 1 is not provided with the upper block deck, the upper part of the water jacket wall 4 tends to readily vibrate in the lateral directions, i.e. in the direction peripendicular to a row of the plurality of cylinder sections 3, under the action of impact by fuel combustion or explosion. The thus generated vibration of water jacket wall upper part cannot be effectively suppressed since the movement of the water jacket wall upper section is restricted merely by the frictional force due to the pressing-contact of the cylinder head 6 through the head gasket 7. As a result, an extremely high level of noise is radiated from the engine having the above-mentioned cylinder block configuration. Furthermore, by the vibration of the upper part of the water jacket wall 4, the head gasket 7 contacted to the water jacket wall upper part tends to be damaged, which results in leakage of coolant water in the water jacket 18.

Figure 3:
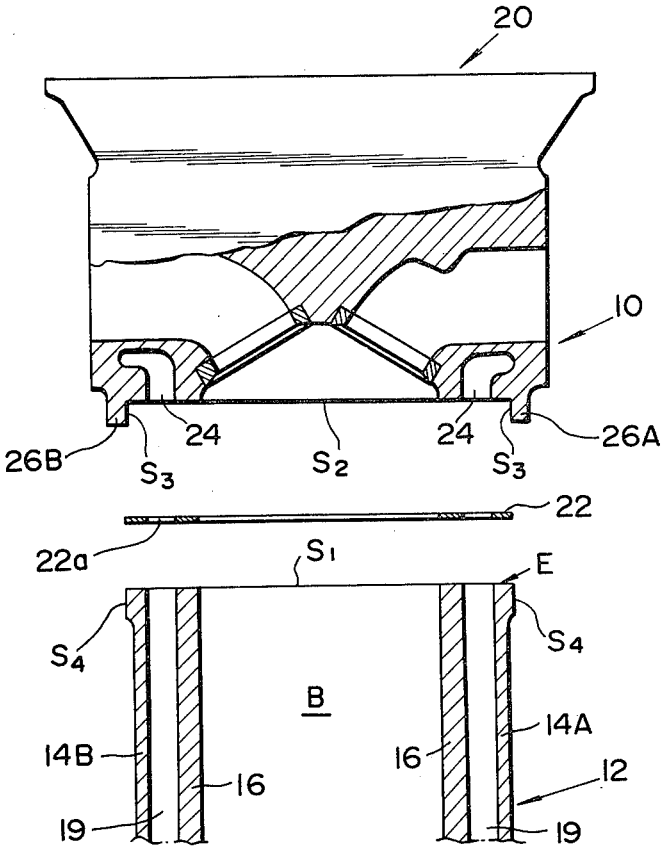
FIG. 3 is an exploded fragmentary sectional view of an internal combustion engine in accordance with the present invention.
Figure 4:
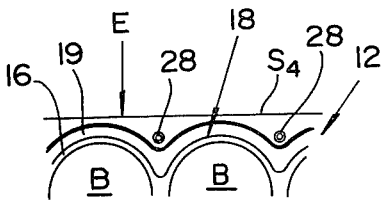
FIG. 4 is a fragmentary top plan view of an example of the cylinder block of the engine of FIG. 3.
Figure 5:
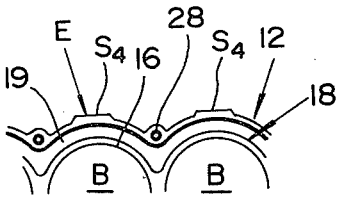
FIG. 5 is a fragmentary top plan view of another example of the cylinder block of the engine of FIG. 3.

In view of the above description of the conventional engine configuration, reference is now made to FIGS. 3 to 5, particularly to FIGS. 3 and 4, wherein a preferred embodiment of an internal combustion engine for an automotive vehicle, according to the present invention is illustrated by the reference numeral 10. The engine 10 comprises a cylinder block 12 which is made of a light alloy such as aluminium alloy and not provided with a so-called upper block deck, like that of the above-mentioned conventional engine shown in FIGS. 1 and 2. Accordingly, the cylinder block 12 has two oppositely disposed water jacket walls 14A, 14B between which a plurality of cylinder (liner) sections 16 are interposed, forming a cylinder row structure 18 in which the cylinder sections 16 are integral with each other. A water jacket 19 is formed between the cylinder row structure 18 and each water jacket wall 14A, 14B. The water jacket walls 14A, 14B are separate from the cylinder row structure 18 except the lower-most section thereof which is integral with the cylinder row structure 18, though not shown. Each cylinder section 16 is formed therein an engine cylinder bore B in which an engine piston (not shown) is movably disposed. It will be appreciated that, at the upper-most part including top flat surface $S_1$ of the cylinder block 10, the water jacket walls 14A, 14B are completely separate from each cylinder section 16, forming therebetween the water jacket 19.

A cylinder head 20 is secured at its bottom flat surface $S_2$ onto the top flat surface $S_1$ of the cylinder block 12 through a head gasket 22 by using a plurality of cylinder head bolts (not shown). As shown, the cylinder head 20 is formed with a water passage 24 which communicates with the water jacket 19 formed in the cylinder block 12 through an opening 22*a* formed through the head gasket 22. The cylinder head 20 is formed at its bottom surface with two oppositely disposed projections 26A, 26B which elongate parallelly along the axis of the cylinder head and generally throughout the whole length of the cylinder head 20. Each projection 26A, 26B is in the rectangular shape in cross-section and accordingly has an inner side surface $S_3$ serving as a contactable surface to which a contactable surface $S_4$ formed at the upper part of each water jacket wall 14A, 14B is contactable when the cylinder head 20 is secured to the cylinder block 12. As a result, the upper end part or fitting part E of the cylinder block 12 fits in or is tightly disposed between the two projections 26A, 26B of the cylinder head 20. The top surface $S_1$ of the cylinder block 12 is in close contact through the head gasket 22 with the bottom surface $S_2$ of the cylinder head 20, and the contactable surface $S_3$, $S_4$ are in close contact with each other. In this connection, each contactable surface $S_4$ of the cylinder block 12 is elongated generally throughout the length of the cylinder block 12. The contactable surfaces $S_3$, $S_4$ of the cylinder head and block are preferably so machined that the clearance therebetween is within a range of about 0–20 $\mu$m.

While each projection 26A, 26B has been described as elongating throughout the whole length of the cylinder head 20, it will be understood that it may be in the form of a plurality of separate and aligned short pieces of projections each of which is located in the vicinity of the central part of a certain cylinder section 16 which is particularly high in vibration level. Likewise, the contactable surface $S_4$ of the cylinder block water jacket wall 14A, 14B may be in the form of a plurality of separate and aligned short contactable surfaces each of which is located in the vicinity of the central part of a certain cylinder section 16 which is particularly high in vibration level, as shown in FIG. 5. The reference numeral 28 in FIGS. 4 and 5 denotes a hole into which the cylinder head bolt is securely inserted.

With the above-discussed engine configuration, since the cylinder block upper end part E fits in between the opposite projections 26A, 26B formed at the bottom section of the cylinder head 20, the upper end part E of the cylinder block 12 can be completely prevented from expanding-deformation in the lateral direction of the cylinder block 12, in addition to the deformation preventing effect of the frictional force due to the pressing-contact of the cylinder head 20. This greatly reduces the level of the vibration of the water jacket wall upper part in the lateral direction of the cylinder block which vibration is caused by combustion impact force and the like. The deformation preventing effect due to the cylinder head projections 26A, 26B is particularly effective for the central part of each cylinder section 16 which is otherwise restrained only by the cylinder head bolts. As a result, the noise radiated from the upper end part E of the cylinder block 12 can be effectively reduced, decreasing the fatigue of the head gasket 22 caused by vibration between the cylinder block and head 12, 20.

Besides, the conventional light alloy-made cylinder block not provided with an upper deck has been in general low in flexural rigidity in the lateral direction of the cylinder block 1. On the contrary, in the engine according to the present invention, by virtue of fitting the cylinder block upper end part E in between the cylinder head projections 26A, 26B, the cylinder block can be greatly improved as to its lateral direction flexural rigidity and therefore engine noise due to the flexural rigidity can be reduced, thereby achieving a further low noise-level of the engine. Additionally, by so forming the shape of the head gasket 22 as to be able to be properly located in position by the projections 26A, 26B of the cylinder head 20, the operational efficiency for production can be further improved based on the fact that the locationing of the cylinder head 20 relative to the cylinder block 20 is facilitated by virtue of the projections 26A, 26B.

As appreciated from the above, according to the present invention, noise radiated from the cylinder block upper section can be noticeably suppressed, effectively preventing the leakage of coolant water in the engine.

What is claimed is:

1. An automotive internal combustion engine comprising:

a cylinder head having at its bottom surface two oppositely disposed projections which extend along the length of said cylinder head;

a cylinder block having a plurality of cylinder sections, each being formed therein with an engine cylinder bore, and two water jacket walls which are oppositely disposed to interpose therebetween said cylinder sections, each water jacket wall being separate at its upper-most part from each cylinder section and forming therebetween a water jacket, the upper end part containing the water jacket wall upper-most part of said cylinder block having a contacting surface fitting inbetween said two projections of said cylinder head to form a tight contact therebetween.

2. An automotive internal combustion engine as claimed in claim 1, wherein each projection of said cylinder head is in the rectangular shape and is formed at its inner surface with a contactable surface which is contactable with the contacting surface of said water jacket wall.

3. An automotive internal combustion engine as claimed in claim 1, wherein each projection of said cylinder head elongates generally throughout the length of said cylinder head.

4. An automotive internal combustion engine as claimed in claim 1, wherein each projection of said cylinder head inacludes a plurality of aligned short projections which are located respectively in the vicinity of predetermined cylinder sections whose vibration levels are higher than those of the other cylinder sections.

5. An automotive internal combustion engine as claimed in claim 1, wherein the contacting surface of said water jacket wall elongates generally throughout the length of said cylinder block.

6. An automotive internal combustion engine as claimed in claim 1, wherein the contacting surface of said water jacket wall includes a plurality of short contactable surfaces which are located respectively in the vicinity of predetermined cylinder sections whose vibration levels are higher than those of the other cylinder sections.

7. An automotive internal combustion engine as claimed in claim 1, wherein said cylinder head has a water passage formed therein which communicates with said water jacket of said cylinder block.

8. An automotive internal combustion engine as claimed in claim 7, further comprising a head gasket disposed between the bottom surface of said cylinder head and the top surface of said cylinder block, and located between said two projections of said cylinder head, said head gasket having an opening through which said water passage of said cylinder head is in communication with said water jacket of said cylinder block.

9. An automotive internal combustion engine as claimed in claim 1, wherein said plurality of cylinder sections are integral with each other to form a cylinder row structure, in which said water jacket is formed along the periphery of said cylinder row structure.

10. An automotive internal combustion engine as claimed in claim 1, wherein said cylinder block is made of a light alloy and produced by die-casting.

* * * * *